US009391408B2

(12) United States Patent
Katayanagi

(10) Patent No.: US 9,391,408 B2
(45) Date of Patent: Jul. 12, 2016

(54) RECEPTACLE CONNECTOR THAT CAN EASILY OBTAIN A DESIRED FRICTION LOCK WITHOUT FORMING A LARGE OPENING IN A METAL SHELL

(71) Applicant: Japan Aviation Electronics Industry, Limited, Tokyo (JP)

(72) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/455,001

(22) Filed: Aug. 8, 2014

(65) Prior Publication Data

US 2015/0118887 A1 Apr. 30, 2015

(30) Foreign Application Priority Data

Oct. 24, 2013 (JP) ..... 2013-221007

(51) Int. Cl.
*H01R 13/627* (2006.01)
*H01R 13/6582* (2011.01)
*H01R 24/60* (2011.01)

(52) U.S. Cl.
CPC ..... *H01R 13/6582* (2013.01); *H01R 24/60* (2013.01)

(58) Field of Classification Search
CPC ..... H01R 13/6275; H01R 13/6273; H01R 13/6272; H01R 13/639; H01R 13/506
USPC ..... 439/353, 366, 137
See application file for complete search history.

(56) References Cited

U.S. PATENT DOCUMENTS 5,338,227 A * 8/1994 Nakamura ..... H01R 13/506 439/352
5,580,268 A * 12/1996 Miyazawa ..... H01R 13/6275 29/868
5,928,035 A 7/1999 Jankowsky et al.
6,007,379 A * 12/1999 Michaelis ..... H01R 23/6873 439/607.04
6,012,948 A * 1/2000 Wu ..... H01R 23/6873 439/567
6,368,154 B1 4/2002 Hirata et al.
6,659,799 B2 * 12/2003 Yang ..... H01R 4/028 439/607.01
6,827,610 B2 12/2004 Lin
7,258,565 B2 * 8/2007 Huang ..... H01R 13/6275 439/353
7,402,080 B2 * 7/2008 Xiao ..... H01R 23/6873 439/607.2
7,708,602 B2 * 5/2010 Rascon ..... H01R 13/64 439/137
7,785,149 B2 * 8/2010 Kamata ..... H01R 13/6275 439/570

(Continued)

FOREIGN PATENT DOCUMENTS

EP 0 898 327 A2 2/1999
JP 2000-323233 A 11/2000
JP 2012-059463 A 3/2012

OTHER PUBLICATIONS

Chinese Office Action in CN 2014104783068, dated May 4, 2016, with English translation.

*Primary Examiner* — Abdullah Riyami
*Assistant Examiner* — Vladimir Imas
(74) *Attorney, Agent, or Firm* — Collard & Roe, P.C.

(57) ABSTRACT

A locking portion formed by bending is provided at a free end portion of a cantilever-like spring piece extending from a shell body on the outer side of a receptacle connector and folded back outward. The locking portion protrudes into the shell body through a hole of the shell body. Then, a sheared surface, formed by press working, of the locking portion is brought into contact with a plug connector fitted into the shell body, thereby obtaining a friction lock between the receptacle connector and the plug connector.

8 Claims, 7 Drawing Sheets

(56) References Cited

U.S. PATENT DOCUMENTS 7,955,129 B2 * 6/2011 Hu ..... H01R 12/57 439/607.01
8,100,709 B2 * 1/2012 Zhang ..... H01R 13/6275 439/353
2005/0282424 A1 * 12/2005 Huang ..... H01R 13/6275 439/353
2008/0220663 A1 * 9/2008 Ma ..... H01R 13/6582 439/733.1
2010/0273360 A1 * 10/2010 Chen ..... H01R 13/65802 439/676
2012/0322282 A1 * 12/2012 Naito ..... H01R 13/7039 439/137
2014/0235108 A1 * 8/2014 Shiratori ..... H01R 13/652 439/660
2014/0322953 A1 * 10/2014 Katayanagi ..... H01R 13/6582 439/353
2015/0064958 A1 * 3/2015 Katayanagi ..... H01R 29/00 439/366
2015/0118887 A1 * 4/2015 Katayanagi ..... H01R 13/658 439/353
2015/0194770 A1 * 7/2015 Little ..... H01R 13/6586 439/607.27

* cited by examiner

RECEPTACLE CONNECTOR THAT CAN EASILY OBTAIN A DESIRED FRICTION LOCK WITHOUT FORMING A LARGE OPENING IN A METAL SHELL

This application is based upon and claims the benefit of priority from Japanese patent application No. 2013-221007, filed on Oct. 24, 2013, the disclosure of which is incorporated herein in its entirely by reference.

BACKGROUND OF THE INVENTION

1. Field of the Invention

This invention relates to an electrical connector and specifically relates to a receptacle connector with a metal shell having an electromagnetic shield function.

2. Description of Related Art

Small electrical connectors are widely used in mobile devices such as notebook personal computers. Recently, plug connectors and receptacle connectors as this type of electrical connectors each comprise a metal shell having an electromagnetic shield function. In order to reduce the size of the connector, there are instances where the thickness of the metal shell of particularly the receptacle connector is designed to be as thin as, for example, about 0.25 mm.

A technique which is expected to be applicable to a small connector is described in, for example, JP-A-2000-323233 (hereinafter referred to as "Patent Document 1") or JP-A-2012-59463 (hereinafter referred to as "Patent Document 2").

Referring to FIG. 1, a connector device disclosed as a prior art in Patent Document 1 will be briefly described. The illustrated connector device comprises a shield 1. The shield 1 has a spring piece 2 formed by cutting out a part of the shield 1. The spring piece 2 is bent toward the inside of the shield 1. When a mating connector (not illustrated) is inserted to a predetermined position inside the shield 1, a free end portion 3 of the spring piece 2 is brought into contact with the mating connector so that mechanical connection therebetween is maintained. In Patent Document 1, a connector device disclosed as an embodiment of the invention also has the same structure for a spring piece.

Next, referring to FIG. 2, a shield case of a receptacle disclosed in Patent Document 2 will be briefly described. In the illustrated receptacle, the shield case comprises a shield case body 5. The shield case body 5 is integrally formed with spring pieces 6. Each spring piece 6 extends along the outer side of the shield case body 5 and is bent toward the inside of the shield case body 5 so as to be introduced into the shield case body 5 through a through hole 7 formed in the shield case body 5. When a plug (not illustrated) is inserted into the shield case body 5, free end portions 6A of the spring pieces 6 are brought into contact with a metal shell of the plug. In this manner, the metal shell of the plug is grounded through the shield case body 5, thereby obtaining an electromagnetic shield effect. Incidentally, in the receptacle of FIG. 2, the spring pieces 6 are not for the purpose of maintaining mechanical connection between the shield case body 5 and the metal shell of the plug.

SUMMARY OF THE INVENTION

In FIG. 1, the structure is such that the spring piece 2 is formed by cutting out the part of the shield 1 and further that the free end portion 3 of the spring piece 2 is brought into surface contact with the mating connector. Therefore, there is no alternative but to form a large opening in the shield 1. In FIG. 2, the structure is such that the free end portions 6A of the spring pieces 6 are each brought into surface contact with the metal shell of the plug. Therefore, the through holes 7 of the shield case body 5 cannot be made small. Consequently, the large opening or openings are formed in the shield 1 or the shield case body 5, resulting in a reduction in the strength and shield function of the shield 1 or the shield case body 5.

Further, there is a difficulty in increasing the spring force of the spring piece 2 or each spring piece 6. That is, if the width of the spring piece 2 or each spring piece 6 is designed to be greater for increasing the spring force, the above-mentioned opening should be made greater, resulting in a further reduction in the strength and shield function of the shield 1 or the shield case body 5.

In particular, if the thickness of the shield 1 or the shield case body 5 is designed to be thinner, the strength of the shield 1 or the shield case body 5 is further reduced and besides the spring force of the spring piece 2 or each spring piece 6 is also reduced. On the other hand, if the thickness of the shield 1 or the shield case body 5 is designed to be greater, it is difficult to achieve size reduction of the connector.

It is therefore an exemplary object of this invention to provide a receptacle connector that can solve the above-mentioned problems.

Other objects of this invention will become clear as the description proceeds.

According to an exemplary aspect of the present invention, there is provided a receptacle connector comprising a metal shell on its outer side, wherein the metal shell comprises a shell body, a cantilever-like spring piece extending from a specific end portion of the shell body and folded back outward, and a locking portion formed at a free end portion of the spring piece by bending, wherein the shell body has a hole allowing insertion of the locking portion therethrough, wherein the locking portion has a sheared surface formed by press working and protrudes into the shell body through the hole, and wherein the sheared surface is brought into contact with a plug connector fitted into the shell body, thereby obtaining a friction lock.

DESCRIPTION OF THE EXEMPLARY EMBODIMENTS

Figure 1:
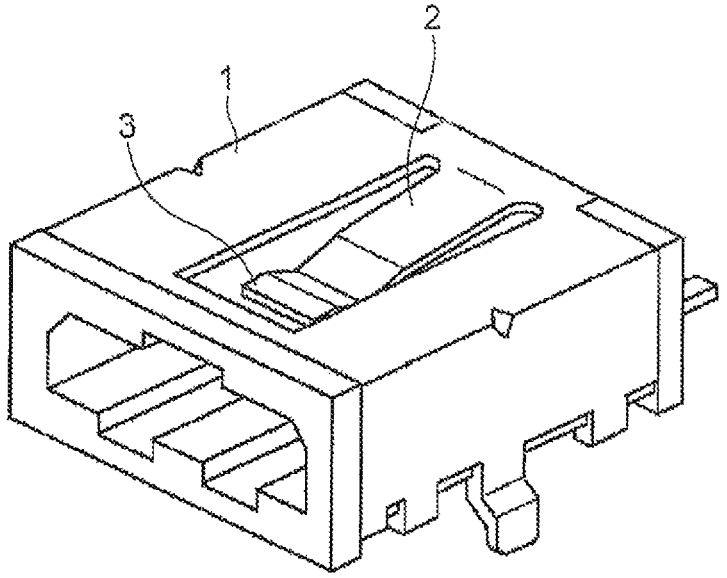
PRIOR ART FIG. 1
FIG. 1 is a perspective view of a connector device disclosed as a prior art in Patent Document 1 (JP-A-2000-323233)
Figure 2:
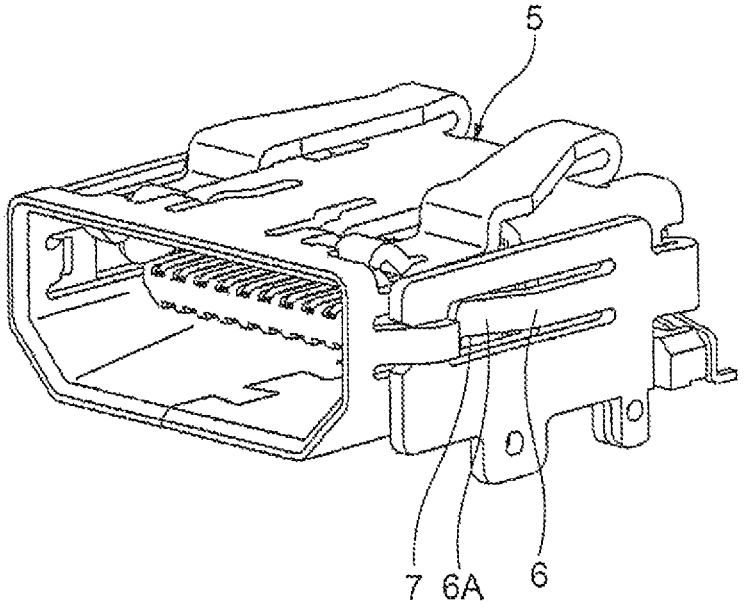
PRIOR ART FIG. 2
FIG. 2 is a perspective view of a receptacle disclosed in Patent Document 2 (JP-A-2012-59463)
Figure 3:
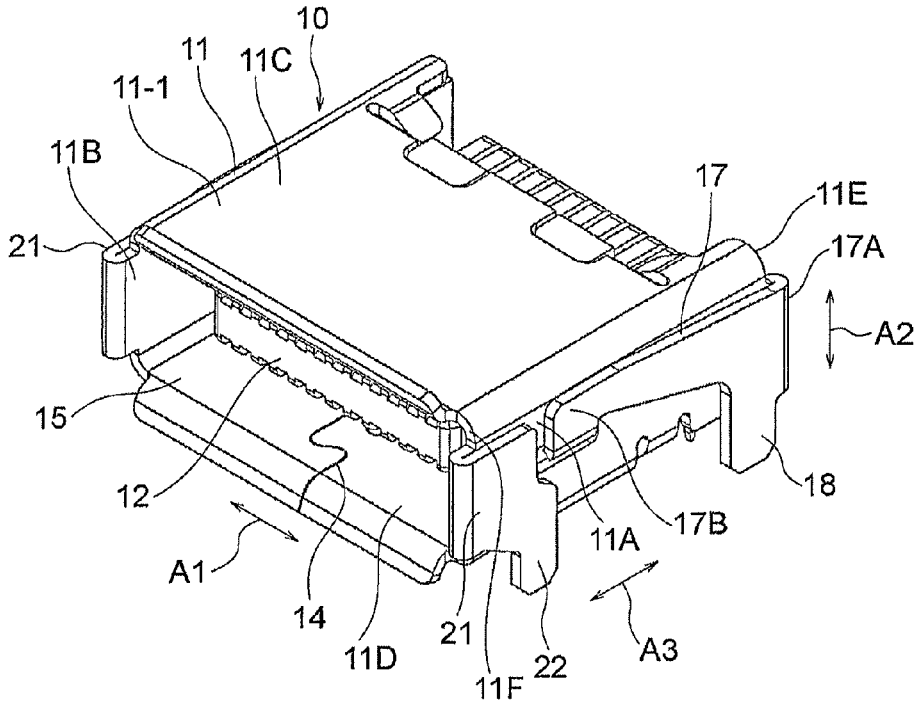
FIG. 3 is an external perspective view of a receptacle connector according to an exemplary embodiment of this invention.
Figure 4:
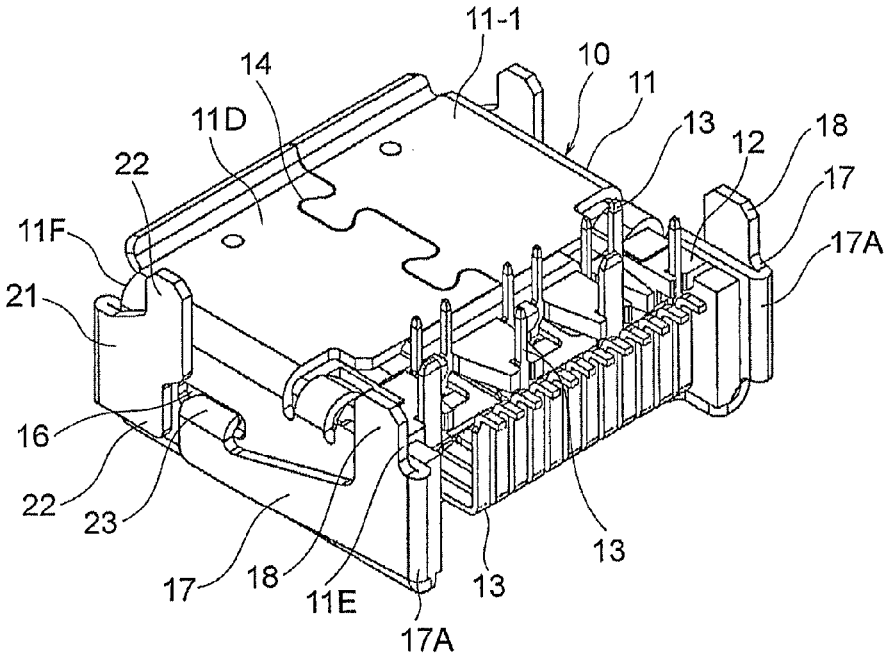
FIG. 4 is an external perspective view of the receptacle connector of FIG. 3 as seen from a different direction.
Figure 5:
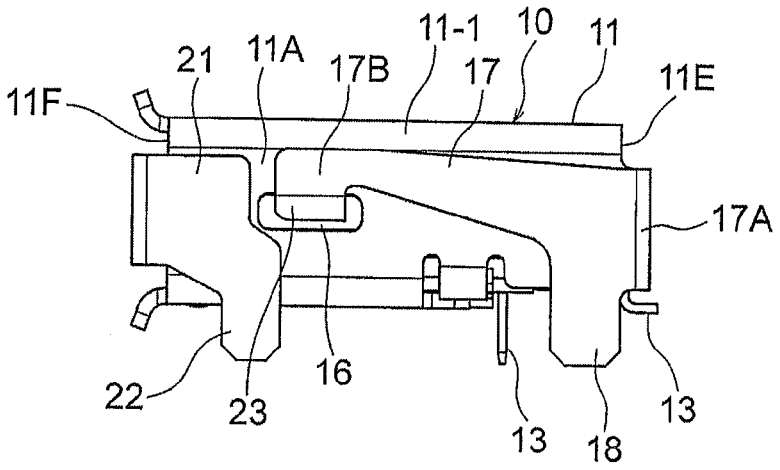
FIG. 5 is a right side view of the receptacle connector of FIG. 3.
Figure 6:
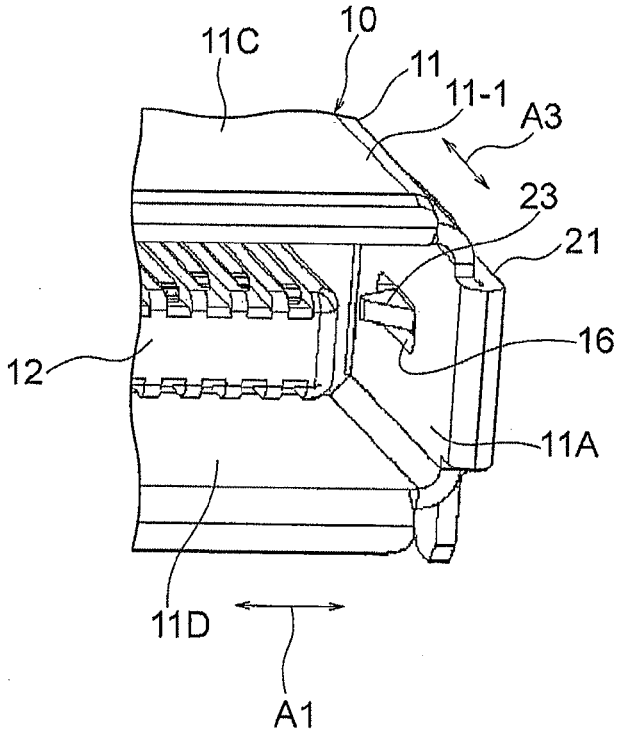
FIG. 6 is a perspective view of a main part of the receptacle connector of FIG. 3 as seen from an another different direction.

Referring to FIGS. 3 to 13, a receptacle connector according to an exemplary embodiment of this invention will be described.

FIGS. 3 to 6 show a receptacle connector 10 as a small electrical connector. The illustrated receptacle connector 10 comprises a metal shell 11, an insulator 12 received in the metal shell 11, and a plurality of conductive contacts 13 held by the insulator 12.

The metal shell 11 is formed by applying press working to a metal plate and comprises a shell body 11-1 having a hollow rectangular parallelepiped shape with a rectangular cross section and having side walls 11A and 11B facing each other with a space therebetween in a right-left direction A1, an upper wall 11C, and a lower wall 11D. The lower wall 11D has a seam 14 where ends of the metal plate meet.

The shell body 11-1 defines a fitting opening 15 through which a plug connector 30 (see FIG. 12) as a mating electrical connector is fitted into the shell body 11-1. The side walls 11A and 11B of the shell body 11-1 are each formed with a substantially rectangular small hole 16 at its portion relatively near the fitting opening 15. The size of the rectangular hole 16 will become clear later.

Further, the side walls 11A and 11B of the shell body 11-1 are each provided with a plate-like spring piece 17. Each spring piece 17 is formed to extend from a specific end portion of the shell body 11-1, for example, a rear end portion 11E on the side opposite to the fitting opening 15. Then, each spring piece 17 is smoothly bent outward and folded back so as to extend forward. In this manner, each spring piece 17 is in the form of a cantilever whose root portion 17A near the rear end portion 11E of the shell body 11-1 is supported by the shell body 11-1. Since each spring piece 17 is folded back outward from the rear end portion 11E of the shell body 11-1, it can be formed without receiving restriction of an inner space of the shell body 11-1.

Each spring piece 17 is formed wider at its root portion 17A than at its free end portion 17B. Since the width of the root portion 17A near the rear end portion 11E of the shell body 11-1 is large, the rear end portion 11E of the shell body 11-1 is reinforced by each spring piece 17. Therefore, even when the plug connector 30 is fitted into the shell body 11-1 to press the shell body 11-1 outward, deformation of the rear end portions 11E of the shell body 11-1 is suppressed by the root portions 17A of the spring pieces 17.

A fixing portion 18 in the form of an extension piece extending downward is integrally formed with each spring piece 17 at its root portion 17A or at its portion near the root portion 17A.

Further, a reinforcing piece 21 extending from each of the side walls 11A and 11B is provided at an end portion on the fitting opening 15 side, i.e. a front end portion 11F, of the shell body 11-1. The reinforcing piece 21 is folded back outward from each of the side walls 11A and 11B and extends rearward. Accordingly, the front end portions 11F of the shell body 11-1 are reinforced by the reinforcing pieces 21. Therefore, even when the plug connector 30 is fitted into the shell body 11-1 to press the shell body 11-1 outward, deformation of the front end portions 11F of the shell body 11-1 is suppressed by the reinforcing pieces 21. That is, the fitting opening 15 is reinforced so that the rigidity of the shell body 11-1 is enhanced.

Each reinforcing piece 21 is also integrally formed with a fixing portion 22 in the form of an extension piece extending downward. As will be described later, the fixing portions 18 and 22 are used for mounting the receptacle connector 10 on a board 26 (see FIG. 11).

Figure 7:
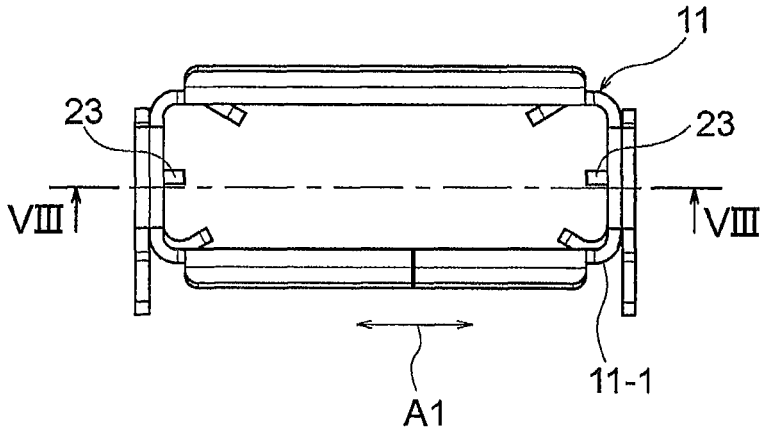
FIG. 7 is a front view of a metal shell of the receptacle connector of FIG. 3.
Figure 8:
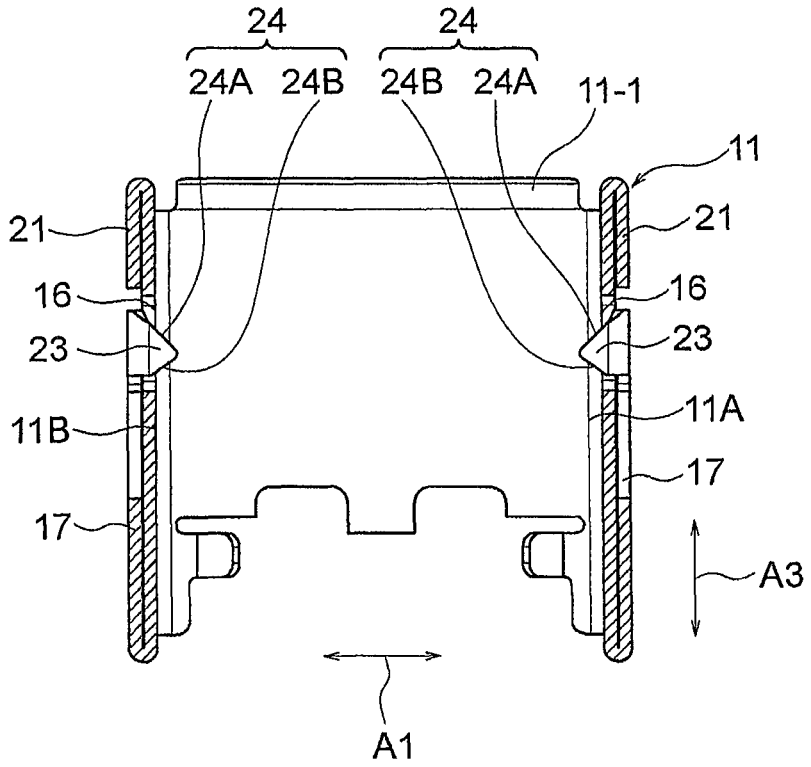
FIG. 8 is a cross-sectional view taken along line VIII-VIII of FIG. 7.
Figure 9:
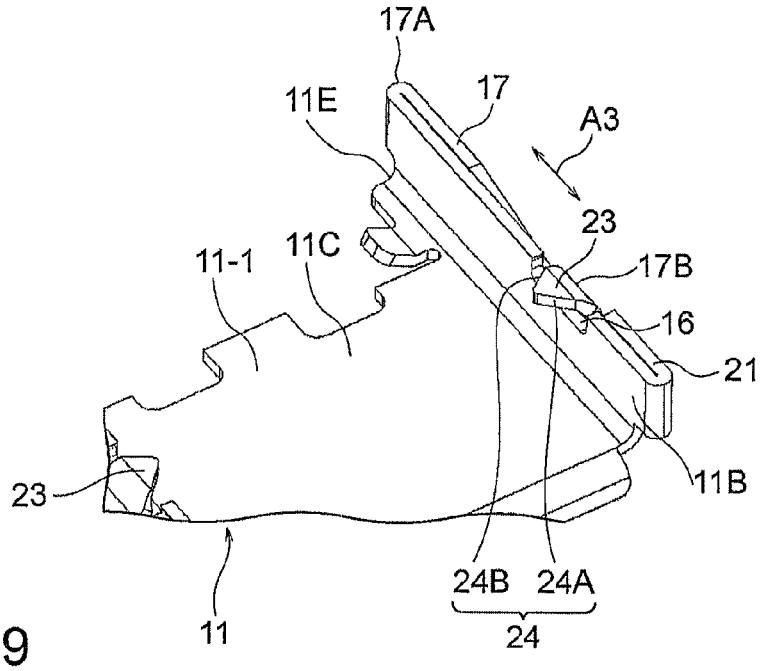
FIG. 9 is a perspective view of a main part of FIG. 8.

FIGS. 7 to 9 show the metal shell 11. The free end portion 17B of each spring piece 17 is formed with a locking portion 23 by bending. For example, the locking portion 23 can be easily formed by bending inward at a right angle a projection which is integrally formed with the free end portion 17B of the spring piece 17 on its one end side in a height direction (width direction) A2, i.e. on its lower end side. The formed locking portion 23 is in the form of a plate-like portion parallel to a plane extending in a fitting/removing direction of the plug connector 30, i.e. a front-rear direction A3, and in the right-left direction A1.

The spring pieces 17 and the locking portions 23 are integrally formed with the shell body 11-1 by applying press working to the metal plate, thus being excellent in manufacturability and dimensional accuracy.

Each locking portion 23 is left with a sheared surface 24 formed by the press working. Then, the locking portions 23 are projected to the inside of the shell body 11-1 through the rectangular holes 16 of the side walls 11A and 11B, respectively. In this manner, the sheared surfaces 24 are located inside the shell body 11-1. Each sheared surface 24 in its original state has minute projections caused by shearing.

Herein, the size of each rectangular hole 16 of the shell body 11-1 allows the insertion of the locking portion 23, but is preferably as small as possible in order to suppress a reduction in the electromagnetic shield function or strength of the shell body 11-1. With the above-mentioned shape and posture of the locking portion 23, the size of the rectangular hole 16 can be easily designed to be small. Therefore, there is little possibility that the rectangular holes 16 reduce the electromagnetic shield function or strength of the shell body 11-1.

As particularly shown in FIGS. 8 and 9, the sheared surface 24 of each locking portion 23 has a guide surface 24A and a holding surface 24B which are inclined in opposite directions with respect to the front-rear direction A3. By forming the locking portion 23 by the press working, inclination angles of the guide surface 24A and the holding surface 24B can be freely set. At least the holding surface 24B is left with the above-mentioned minute projections after the press working.

Figure 10:
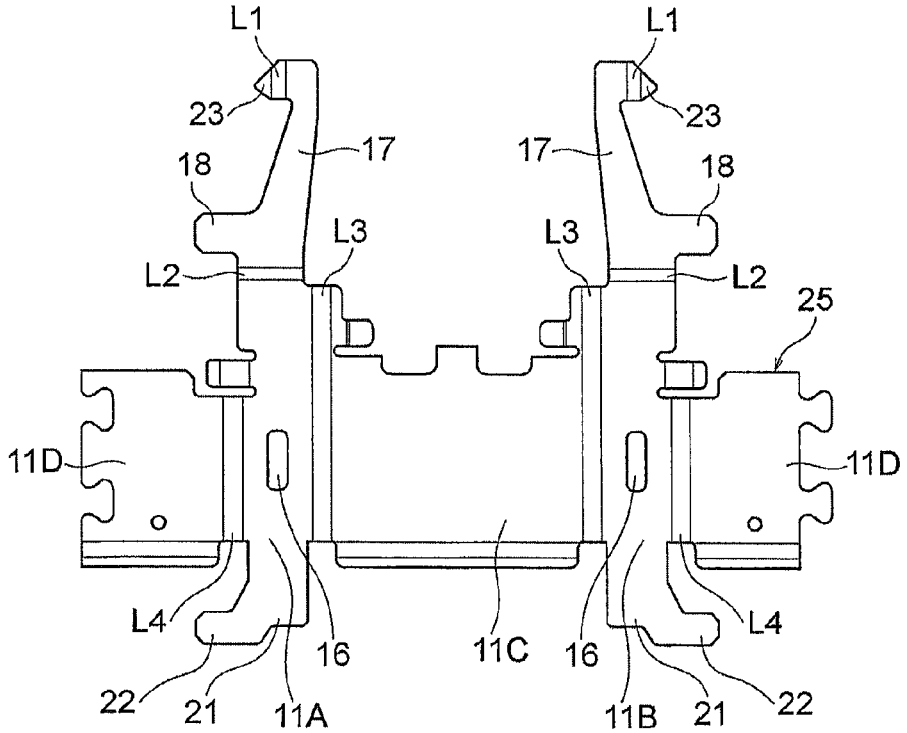
FIG. 10 is a plan view of a punched member for forming the metal shell of FIG. 7.

Next, referring to FIG. 10, the manufacture of the metal shell 11 will be described. In FIG. 10, the same reference symbols are assigned to portions corresponding to those of the metal shell 11 described above.

First, a punched member 25 having a shape of FIG. 10 is obtained by applying press working to a metal plate. The metal shell 11 shown in FIGS. 7 to 9 is manufactured by suitably bending the punched member 25.

Herein, particularly the formation of the locking portions 23 will be described in detail. It is assumed that each locking portion 23 has the sheared surface 24 in its original state as it was sheared by the press working. Each locking portion 23 is bent at a right angle toward the front side of the drawing sheet along a bending portion L1. Then, each spring piece 17 is bent toward the front side of the drawing sheet along a bending portion L2 and then folded back. As a result, each locking portion 23 passes through the rectangular hole 16 to extend to the back side of the drawing sheet.

Then, the other portions are also bent as required and then the side walls 11A and 11B and the lower wall 11D are bent along bending portions L3 and L4, thereby obtaining the metal shell 11 shown in FIGS. 7 to 9.

Figure 11:
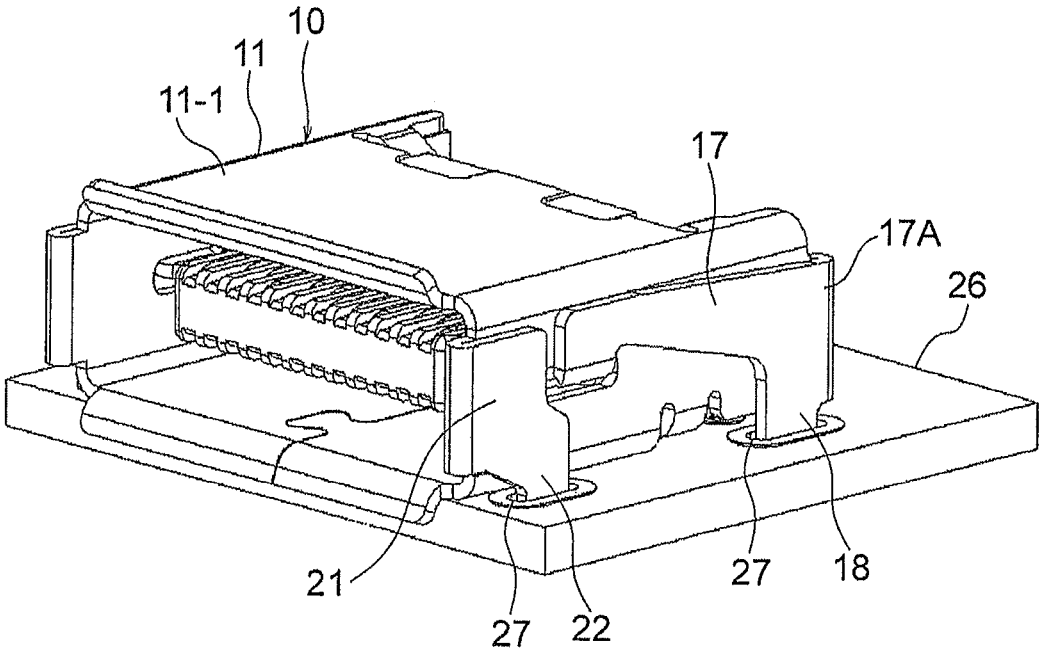
FIG. 11 is a perspective view showing a state where the receptacle connector of FIG. 3 is mounted on a board.

FIG. 11 shows a state where the above-mentioned receptacle connector 10 is mounted on the board 26 (so-called on-board mounting). In this case, the shell body 11-1 is placed on an upper surface of the board 26. The fixing portions 18 and 22 are respectively inserted into four through holes formed in the board 26 and then firmly joined to the board 26 by soldered portions 27 with no play. As a result, the root portion 17A or its neighboring portion of each spring piece 17 is fixed to the board 26 through the fixing portion 18 so that the substantial length of the spring piece 17 is determined. Therefore, the design of a spring force of the spring piece 17 is easy. That is, a spring force as calculated can be easily obtained.

Figure 12:
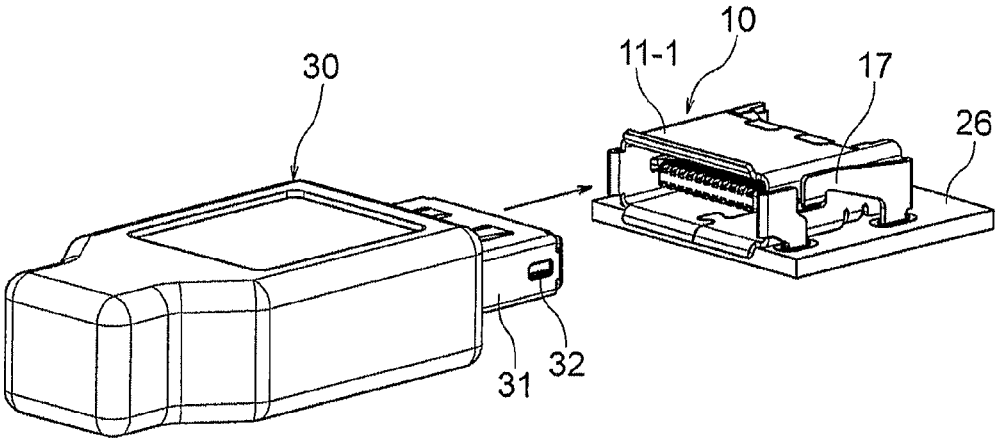
FIG. 12 is an external perspective view showing a state before a plug connector is connected to the receptacle connector of FIG. 3.
Figure 13:
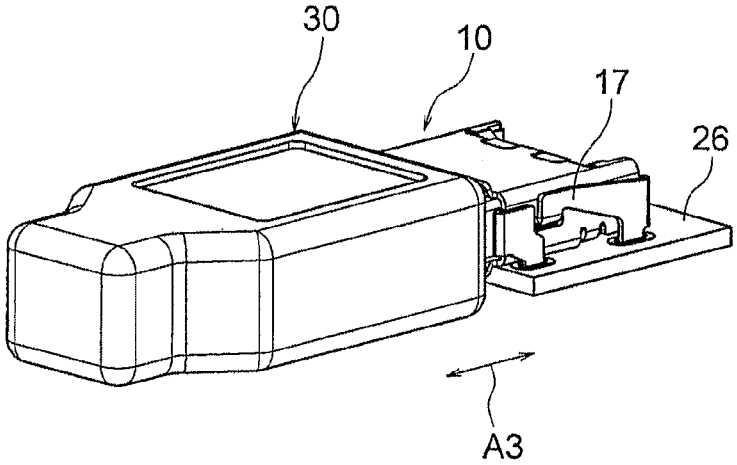
FIG. 13 is an external perspective view showing a state after the plug connector is connected to the receptacle connector of FIG. 3.

FIG. 12 shows a state before the plug connector 30 is fitted and connected to the receptacle connector 10. FIG. 13 shows a state after the plug connector 30 is fitted and connected to the receptacle connector 10.

Referring to FIGS. 12 and 13 along with FIGS. 8 and 9, a description will be continued. When the plug connector 30 is inserted into the shell body 11-1 of the receptacle connector 10, first, a metal shell 31 of the plug connector 30 pushes the guide surfaces 24A of the locking portions 23 to bend the spring pieces 17 outward. When the plug connector 30 is inserted to a predetermined position, the locking portions 23 fall into openings or depressions 32 formed on the metal shell 31 of the plug connector 30. In this state, even if a small pull-out force is applied to the plug connector 30, the holding surfaces 24B engage with edge portions of the openings or depressions 32 so that a so-called friction lock is obtained, and therefore, the plug connector 30 is not easily removed from the receptacle connector 10. Further, since the holding surfaces 24B have the minute projections caused by shearing, the engagement with the edge portions of the openings or depressions 32 is effectively obtained and therefore a sufficiently large friction lock force can be obtained between the receptacle connector 10 and the plug connector 30.

When a pull-out force greater than a predetermined force is applied to the plug connector 30, the holding surfaces 24B slide on the edge portions of the openings or depressions 32 so that the locking portions 23 exit from the openings or depressions 32 while bending the spring pieces 17 outward. Accordingly, thereafter, the plug connector 30 can be easily removed from the receptacle connector 10.

As described above, the receptacle connector 10 which has been described with reference to FIGS. 3 to 13 can easily enhance the friction lock function without reducing its electromagnetic shield effect or strength.

This invention is applicable to a small electrical connector for use in a mobile device such as a notebook personal computer.

A part or the whole of this invention can also be described as the following supplementary notes, but is not limited thereto.

(Supplementary note 1) A receptacle connector 10 comprising a metal shell 11 on its outer side, wherein the metal shell comprises:

a shell body 11-1;

a cantilever-like spring piece 17 extending from a specific end portion of the shell body and folded back outward; and a locking portion 23 formed at a free end portion of the spring piece by bending, wherein the shell body has a hole 16 allowing insertion of the locking portion (or of only the locking portion) therethrough, wherein the locking portion has a sheared surface 24 formed by press working and protrudes into the shell body through the hole, and wherein the sheared surface is brought into contact with a plug connector 30 fitted into the shell body, thereby obtaining a friction lock.

(Supplementary note 2) The receptacle connector according to supplementary note 1, wherein the locking portion is a plate-like portion parallel to a direction in which the plug connector is fitted.

(Supplementary note 3) The receptacle connector according to supplementary note 2, wherein the sheared surface has a guide portion 24A which is inclined so as to guide the fitting of the plug connector.

(Supplementary note 4) The receptacle connector according to any one of supplementary notes 1-3, wherein the shell body has a fitting opening 15 through which the plug connector is fitted into the shell body and wherein the specific end portion is an end portion on a side opposite to the fitting opening of the shell body.

(Supplementary note 5) The receptacle connector according to any one of supplementary notes 1-4, wherein the metal shell further comprises a fixing portion 22 for connection to a board, the fixing portion is integrally formed with the spring piece at a position near the specific end portion.

(Supplementary note 6) The receptacle connector according to any one of supplementary notes 1-5, wherein the spring piece is a plate-like member and is formed wider at its root portion 17A near the specific end portion than at its free end portion.

(Supplementary note 7) The receptacle connector according to any one of supplementary notes 1-6, wherein the spring piece is a plate-like member and wherein the locking portion is bent at a right angle from one end in a width direction of the spring piece at its free end portion.

(Supplementary note 8) The receptacle connector according to any one of supplementary notes 1-7, wherein the shell body has a hollow rectangular parallelepiped shape and wherein the spring piece is provided at each of side walls, facing each other, of the shell body.

While this invention has been particularly shown and described with reference to the exemplary embodiment, the invention is not limited thereto. It will be understood by those of ordinary skill in the art that various changes in form and details may be made therein without departing from the spirit and scope of this invention as defined by the claims.

What is claimed is:

1. A receptacle connector comprising a metal shell on its outer side, wherein the metal shell comprises:

a shell body;

a cantilever-like spring piece extending from a specific end portion of the shell body and folded back outward; and a locking portion formed at a free end portion of the spring piece by bending, wherein the shell body has a hole allowing insertion of the locking portion therethrough, wherein the locking portion has a sheared surface formed by press working and protrudes into the shell body through the hole, and wherein the sheared surface is pushed by a plug connector so as to bend the spring piece outward when the plug connector is inserted into the shell body, and engages with the plug connector so as to obtain a friction lock when the plug connector is fitted therein.

2. The receptacle connector according to claim 1, wherein the locking portion is a plate-like portion parallel to a direction in which the plug connector is fitted.

3. The receptacle connector according to claim 2, wherein the sheared surface has a guide portion which is inclined so as to guide the fitting of the plug connector.

4. The receptacle connector according to claim 1, wherein the shell body has a fitting opening through which the plug connector is fitted into the shell body and wherein the specific end portion is an end portion on a side opposite to the fitting opening of the shell body.

5. The receptacle according to claim 1, wherein the metal shell further comprises a fixing portion for connection to a board, the fixing portion is integrally formed with the spring piece at a position near the specific end portion.

6. The receptacle connector according to claim 1, wherein the spring piece is a plate-like member and is formed wider at its root portion near the specific end portion than at its free end portion.

7. The receptacle connector according to claim 1, wherein the spring piece is a plate-like member and wherein the locking portion is bent at a right angle from one end in a width direction of the spring piece at its free end portion.

8. The receptacle connector according to claim 1, wherein the shell body has a hollow rectangular parallelepiped shape and wherein the spring piece is provided at each of side walls, facing each other, of the shell body.

* * * * *